US006170225B1

(12) United States Patent
Cervantes et al.

(10) Patent No.: US 6,170,225 B1
(45) Date of Patent: Jan. 9, 2001

(54) LOW SPEED CONTAINER PACKAGE FORMING MACHINE

(75) Inventors: Francisco Cervantes, Cd. Satélite; Luis Miguel Diaz, Ilanepantio, both of (MX)

(73) Assignee: Illinois Tool Works Inc., Glenview, IL (US)

( * ) Notice: Under 35 U.S.C. 154(b), the term of this patent shall be extended for 0 days.

(21) Appl. No.: 09/058,299

(22) Filed: Apr. 10, 1998

(30) Foreign Application Priority Data

Apr. 10, 1997 (MX) ..... 97/02628

(51) Int. Cl.[7] ..... B65B 53/00
(52) U.S. Cl. ..... 53/48.4; 53/556
(58) Field of Search ..... 53/48.4, 48.5, 53/48.3, 585, 591, 398, 556, 501; 264/290.2

(56) References Cited

U.S. PATENT DOCUMENTS 2,864,212 * 12/1958 Bruce ..... 53/556 X
3,032,944 5/1962 Hull et al. .
3,193,078 * 7/1965 Amenta et al. ..... 53/501 X
4,250,682 2/1981 Braun .
4,817,361 4/1989 Cunningham .
4,953,343 * 9/1990 Hellman ..... 53/501
5,054,257 * 10/1991 Cunningham et al. ..... 53/48.4

* cited by examiner

*Primary Examiner*—Linda Johnson
(74) *Attorney, Agent, or Firm*—Schwartz & Weinrieb

(57) ABSTRACT

A low speed container packaging machine is provided using a plastic carrier to hold containers and comprising a conveyor moving containers in double rows introducing them to the carrier applying section, receiving and moving them, a pair of cogwheels to locate them in synchronous position below the jaw plates, and thus apply the carrier to the containers. The jaws are mounted on the plates spinning on two axes at preset angles with respect to the horizontal and vertical planes and located symmetrically with respect to the longitudinal axis of the machine. The plates, upon spinning take the carrier strip or fastener from the feed trough and with their jaws, stretch the carrier for a 180° run and locate it on the containers and together with a suitably positioned release plate, deposit the carrier on the containers. Once the carrier is applied on the containers, the containers enter the cut station in which packages of 2, 4, 6, 8 or more containers are formed by means of a novel cutting system.

24 Claims, 10 Drawing Sheets

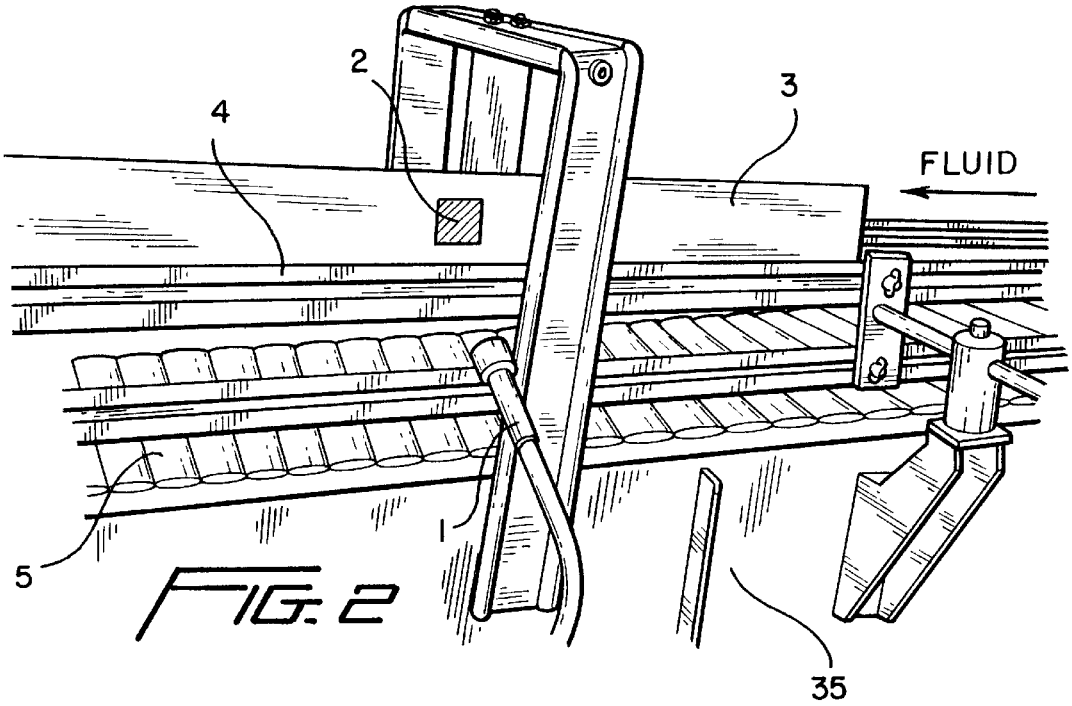
FIG. 2
FIG. 4
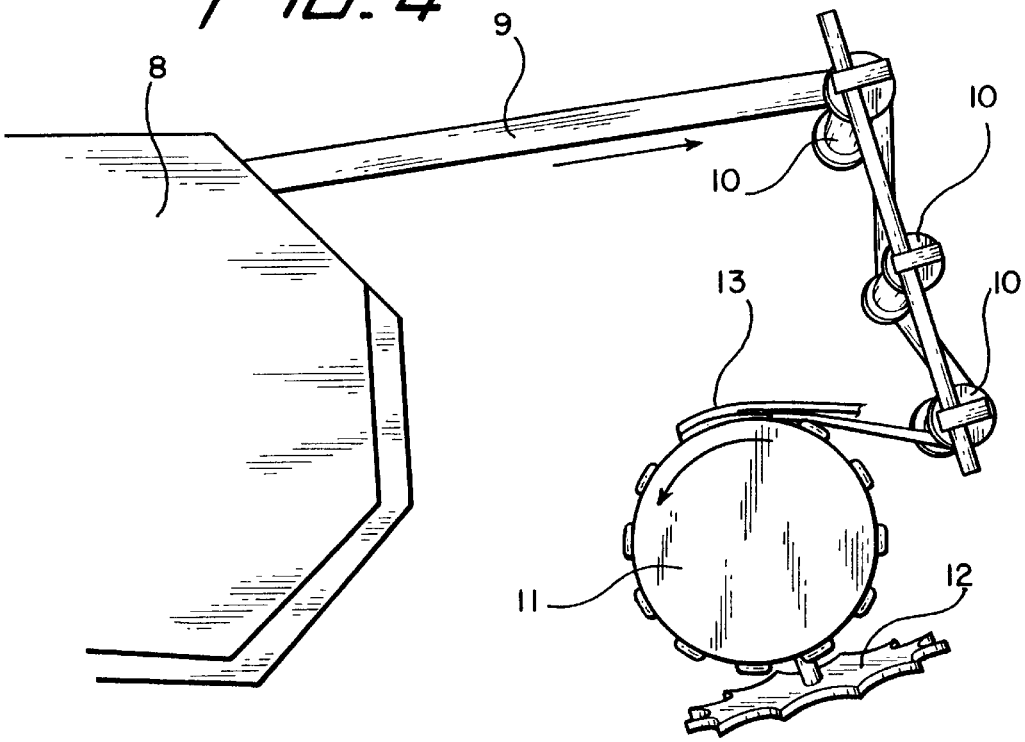

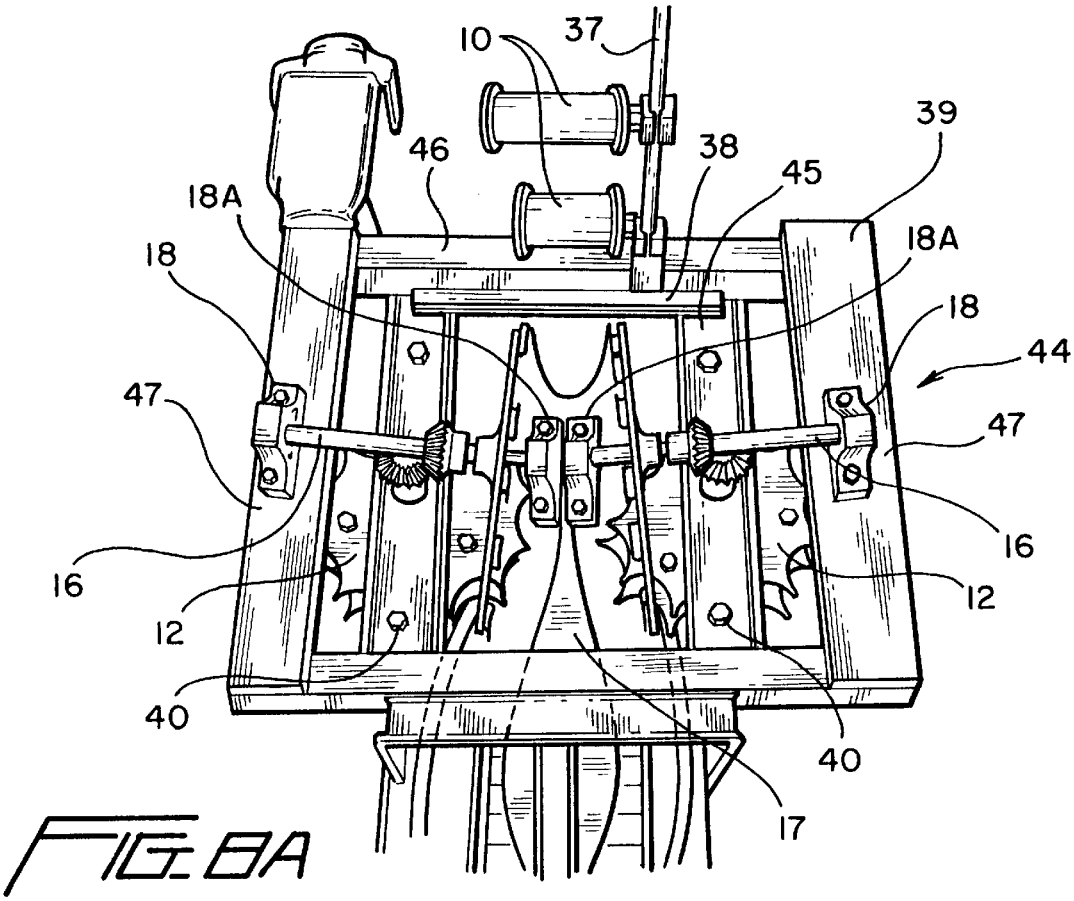
FIG. 8A
FIG. 12
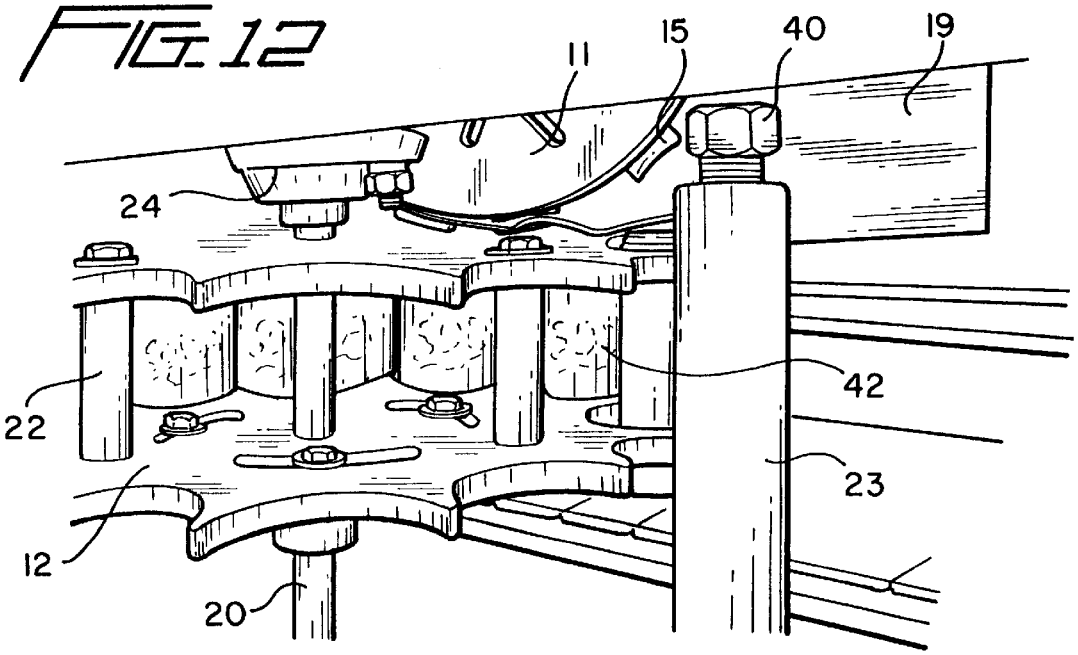

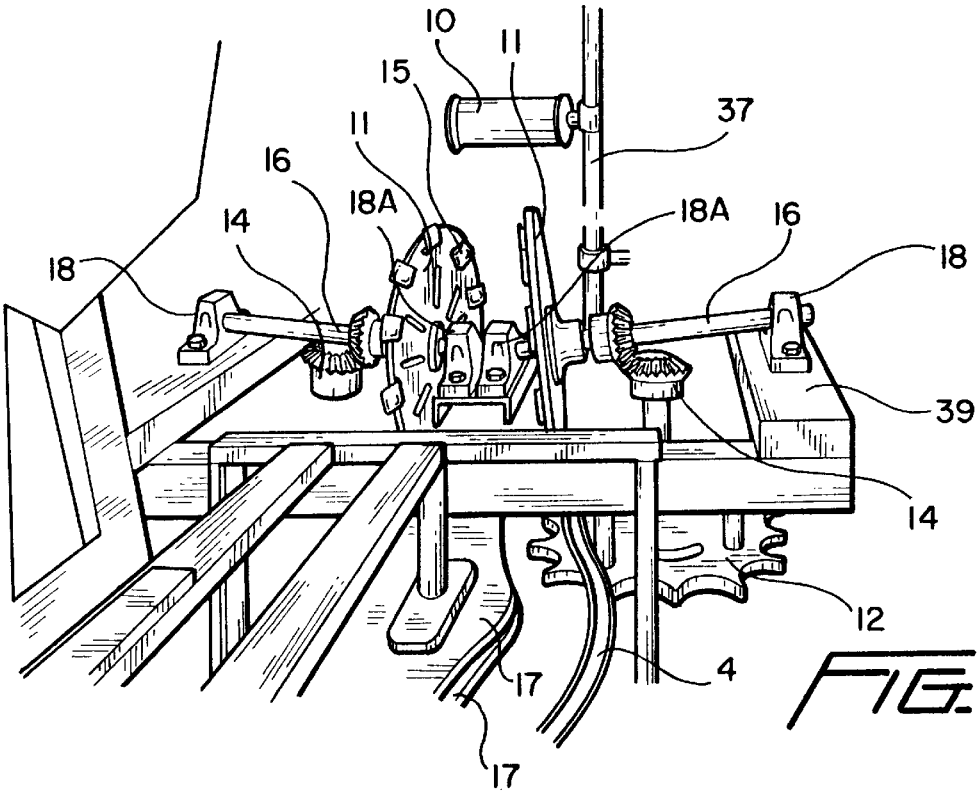
FIG. 9
FIG. 10
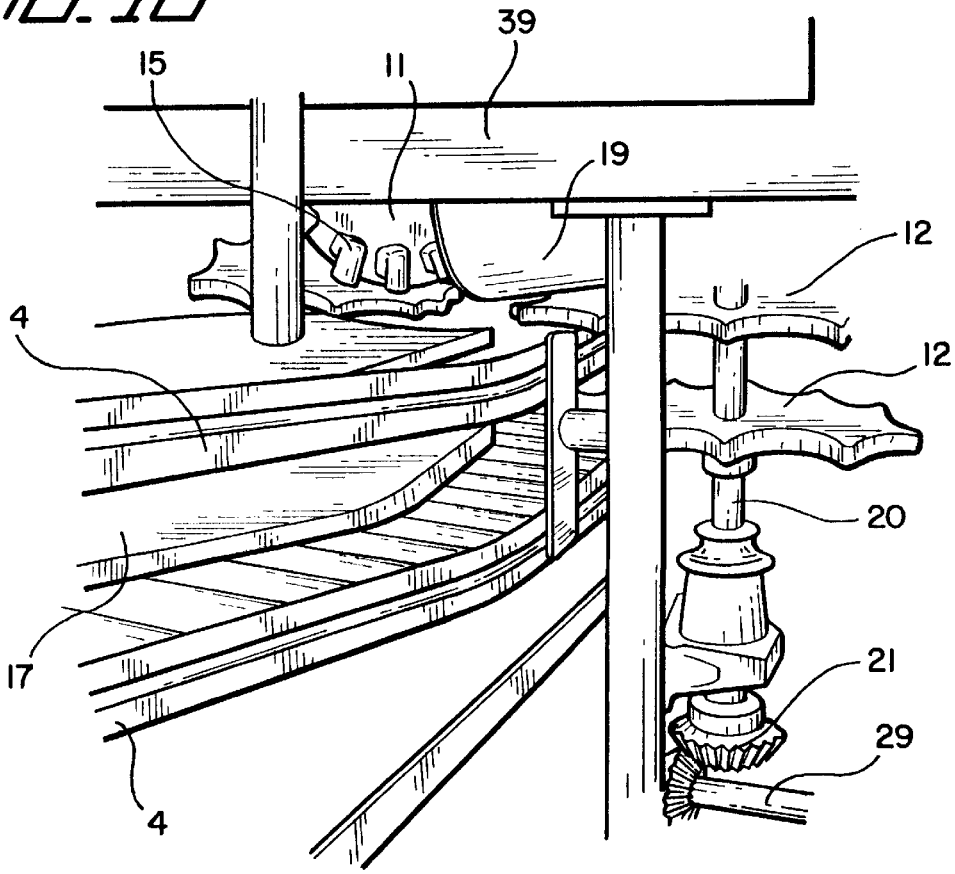

LOW SPEED CONTAINER PACKAGE FORMING MACHINE

FIELD OF THE INVENTION

The present invention refers to container packaging machines and more particularly to low speed container packaging machines which apply plastic wrapping to containers, making packages easily carried.

BACKGROUND OF THE INVENTION

Plastic wrappings or holders are widely known and used due to their low cost. These wrappings can be applied by hand on sundry containers (cans, tins, containers, or the like.,) for a great number of products and materials but due to the high cost of production in the bottling industries for soft drinks, beers, drinking waters, or the like., it is not economically feasible to apply the wrappings by hand and therefore a package forming machine is required for the marketing of such products.

In the state of the art there are some container wrapping machines operating at high speed (at least 900 containers/minute), but it should be noted that currently in the market no low speed machine (500 containers/minute or less) having the features of the present invention. The following briefly describes operation of machines which work in a similar way to that described in the present invention.

The machine subject matter of U.S. Pat. No. 3,032,944 applies the wrapping by means of a rotary drum on which there are located a series of sliding jaws running on tracks. Their movement is controlled by means of a pair of cams, one each located on each side of the drum, and when the drum spins, the jaws slide, opening the carrier to be located on the cans.

U.S. Pat. No. 4,250,682 describes a machine also consisting of a rotary drum with jaws, although differing from the above in that the jaws only on one side slide while the opposite side jaws remain stationary. As in the prior machine the jaws open while the drum spins, thus opening the carrier to locate it on the tin.

In U.S. Pat. No. 3,383,823 is there described another machine for applying a carrier wherein a series of pins catch the carrier, and are separated to open it and locate it on the tins.

One further machine is described in U.S. Pat. No. 4,817,361 consist of two plates with double jaws provided in the periphery for taking the carrier band from a tray and by spinning the plates the carrier opens as said plates spin on an axis offset a certain angle with reference to the horizontal plane of the machine. In contrast to the present invention, this machine merely presents an incline, in the vertical plane, of the movement axis of the plates, while in the present invention there is an incline in the vertical plane, and one in the horizontal plane, which prevents the jaws from striking the containers during operation.

These machines have the disadvantages of being noisy, high production costs, relatively large sizes, complex maintenance and construction, very high operation speeds for some applications, difficult mechanical adjustments for different packages, as well as more working time for different size and diameter dimensions of the containers. The present invention describes a machine that judged by the inventors avoids these and other drawbacks.

OBJECTS OF THE INVENTION

Thus it is a primary object of the present invention to provide a low speed simple machine to package with plastic carriers different types of containers such as cans, tins and bottles of several capacities and types of materials forming thus totally automated packages of 2, 4, 6, 8 or more containers.

The containers subject to packaging by this machine include, but are not limited to soft drinks, beer cans, bottles, juices and preserves. Further, the materials of these containers can include without limitation, aluminum, plastic or steel.

Another object is to provide a low speed packaging machine having a simpler and more economic operation and maintenance.

Another object of the present invention is to provide a machine attending the current need for a low production speed machine (typically 450 containers/minute) with a low cost of manufacture and maintenance.

An additional object of the present invention is to provide a low speed packaging machine having a relatively simple and silent transmission system as compared to those machines of the state of the art currently existing.

Still another object of the present invention is to provide a transmission system which is safe, secure and with a low noise index.

Yet another object of the present invention is to provide a machine with a totally automated and flexible system for cutting the plastic carrier, and which can be programmed to act upon a certain amount of containers per package without substantial production interruption.

BRIEF DESCRIPTION OF THE INVENTION

The invention comprises a plastic carrier packaging machine (3) for a plurality of containers located sideways to form packages of 2, 4, 6, 8 or more containers, which totally and continuously automated. The machine comprises a reel carrier, a feed trough, two plates with jaws, a motor driven conveyor, a removable device, a transmission system, a cutting system and an electric and electronic control device.

The motor driven conveyor carries the aligned containers, two by two, one exactly in front of the other, up to two non-metallic, preferably nylon, star wheels, spinning synchronized with the jaws. For this operation two non-metallic, preferably nylon, guides are used, which will release the pressure on the container line and guide said containers toward said star wheels whereby the containers are located at the exact position to receive the carrier band.

The plates are two solid circular pieces in which the jaws are mounted, taking and stretching transversely the carrier as the plates spin. The jaws are held by means of two screws to the plate peripheries and are located equally spaced therein. Each plate is mounted on a shaft and the longitudinal axes, are non-collinear and forming between them an angle $\alpha$ in the vertical plane from 155° to 175°, preferably 165° and an angle $\beta$ between the same shafts in the horizontal plane from 160° to 180°, preferably 171°. The magnitude of the above referred angles may vary depending mainly on the amount it is desired to open the carrier and the dimensions of the containers, that is, height and diameter, however these angles will always be less than or equal to 180°. As can be seen from the description of the state of the art machines, this double incline in the plates is not provided in any of them. The angle of the plate driving shafts with respect to each other in the vertical plane, enables the plates through the jaws, to open the plastic carrier enough to set this carrier on the containers, while the angle between these shafts in the horizontal plane prevents the containers from colliding with the jaws when moving to the plastic carrier applying position. This angle combination allows the jaws plates upon spinning, to transversely open the carrier to reach the necessary size and thereafter start the closure to be correctly located on the containers passing below these plates on the conveyor and held by the cogwheels or stars.

It was found that the use of this second angle in combination with the transportation and arrangement system of the containers to the carrier application zone, that is to say the plates and nylon stars wheels, provides great advantages especially for preventing abuse or even explosion of the containers as consequence of the pressure in the contain line before and in the carrier application zone. This pressure is originated due to the required production speed, typically 450 containers per minute. It is estimated that a production less than 100 containers per minute would not require this type of system; however, due to the fact that the minimal production rate is greater, this combination is necessary. The second angle avoids engagement of the jaws with the containers as well as with the non-metallic material rails. Said otherwise, this second angle prevent engagement of the jaws of the disks with the containers and the non-metallic material guides as consequence of using this system to release the pressure in the container line.

Another use for the second angle is to prevent the carrier from being disengaged from the jaws before be applied. It was found that without this second angle the carrier would fall before it is applied and that a greater opening in the jaws permanently deforms the carrier. In effect, it was found surprisingly that without this second angle, the carrier, in spite of being held by the jaws from the zone in which it is taken by the disks, fell on the containers before it is applied.

Between both plates and located at the contact level between the carrier and the containers, there is located a separating plate which impedes climbing of the carrier with the jaws forcing their dislodgement. The containers with the carrier or fastener already located are carried by the conveyor to the cutting station. In this station there is located another non-metallic cogwheel, controlled by a manually adjustable brake, although an electromagnetic brake or any other type of automatic brake known to those skilled in the art can be used. This cogwheel limits the movement of the containers to ease the cutting step and to allow the optoelectronic detector to sense the number of containers passed in front of it. The optoelectronic detector can be substituted by an electromechanical switch or similar device.

As already mentioned before, the cutting system counts with an optoelectronic detector mounted on the auxiliary frame of the removable device and its function is to detect the passage and number of containers passing in front of it and to deliver a signal to activate a pneumatic electrovalve actuating a three piece nylon plunger which when descending centers and separates the containers and two knives cut the carrier separating the packages in 2, 4, 6, 8 or more containers according to the electronic selector programming. The whole plunger assembly, that is the pneumatic plunger, nylon centering means and blades or knives, is mounted on a spring hinge, allowing momentary movement together with the containers and returning to the start position once the cut is effected. This hinge is mounted over the auxiliary frame. The plunger is pneumatic although as is evident to an expert in the field another type of plunger or similar device can be employed.

The machine has a removable device which contains a carrier applying system and a part of the transmission system wholly mounted on a main frame. The main frame device of the removable device has been made in a way to obtain the angles $\alpha$ and $\beta$ by the relative position between the support bearings of the driving shafts of the jaws plates. For the first angle, it is obtained by the height difference in the bearing supports of the jaw plate driving shafts and for the second angle, by a shift in the horizontal plane of the central bearings towards the entrance of the containers relative to the external bearings.

The transmission system comprises a main system and two secondary systems. The main system receives movement from the driving system by means of a chain and transmits this movement to the secondary systems by means of helical bevel gears. The shafts seat on the bearings and the type thereof varies depending on the required assembly.

The secondary transmission systems are identical as to the position of the elements thereof but are located on opposite sides of the machine as can be appreciated in the attached drawings.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein:

FIG. 2 is a perspective view of the container feeding zone to the machine, the movement of the containers is from right to left, as indicated by the arrow.

FIG. 4 is a side elevation view showing schematically the path of the plastic carrier in the machine from the reel to the plates.

FIG. 8A is a top plan view of the removable device and the parts holding it.

FIG. 9 is a front perspective view of the jaw plates showing the helical bevel gears and shaft supports.

FIG. 10 is a perspective view in which are shown in detail the release central plate, the stars, the jaw plates and part of a secondary transmission.

FIG. 12 is a perspective view in which are shown the stars and the exit of the containers from the applying zone.

DETAILED DESCRIPTION OF THE INVENTION

Figure 1:
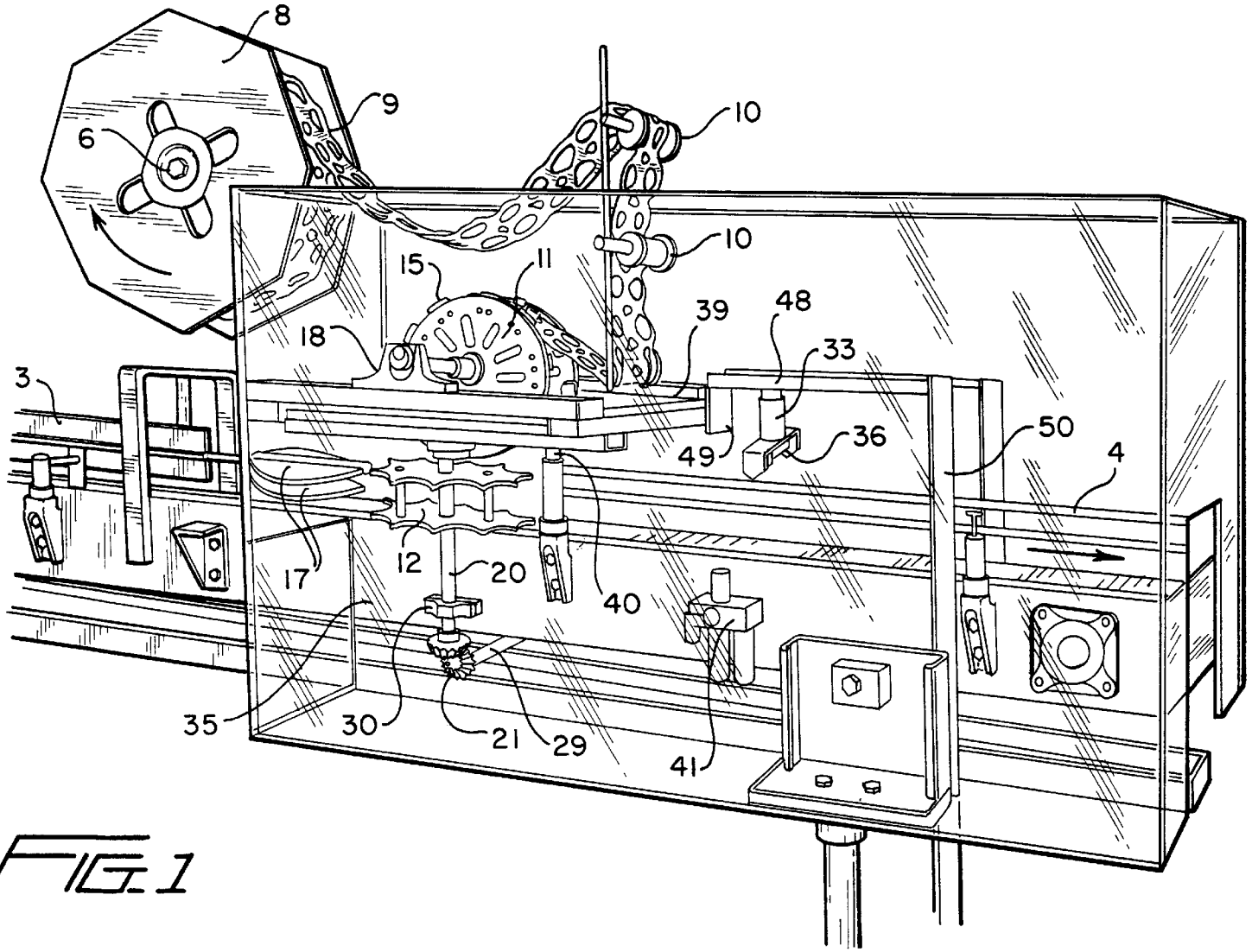
FIG. 1 is a perspective view of the packaging machine and shows the reel and the carrier in working position.
Figure 5:
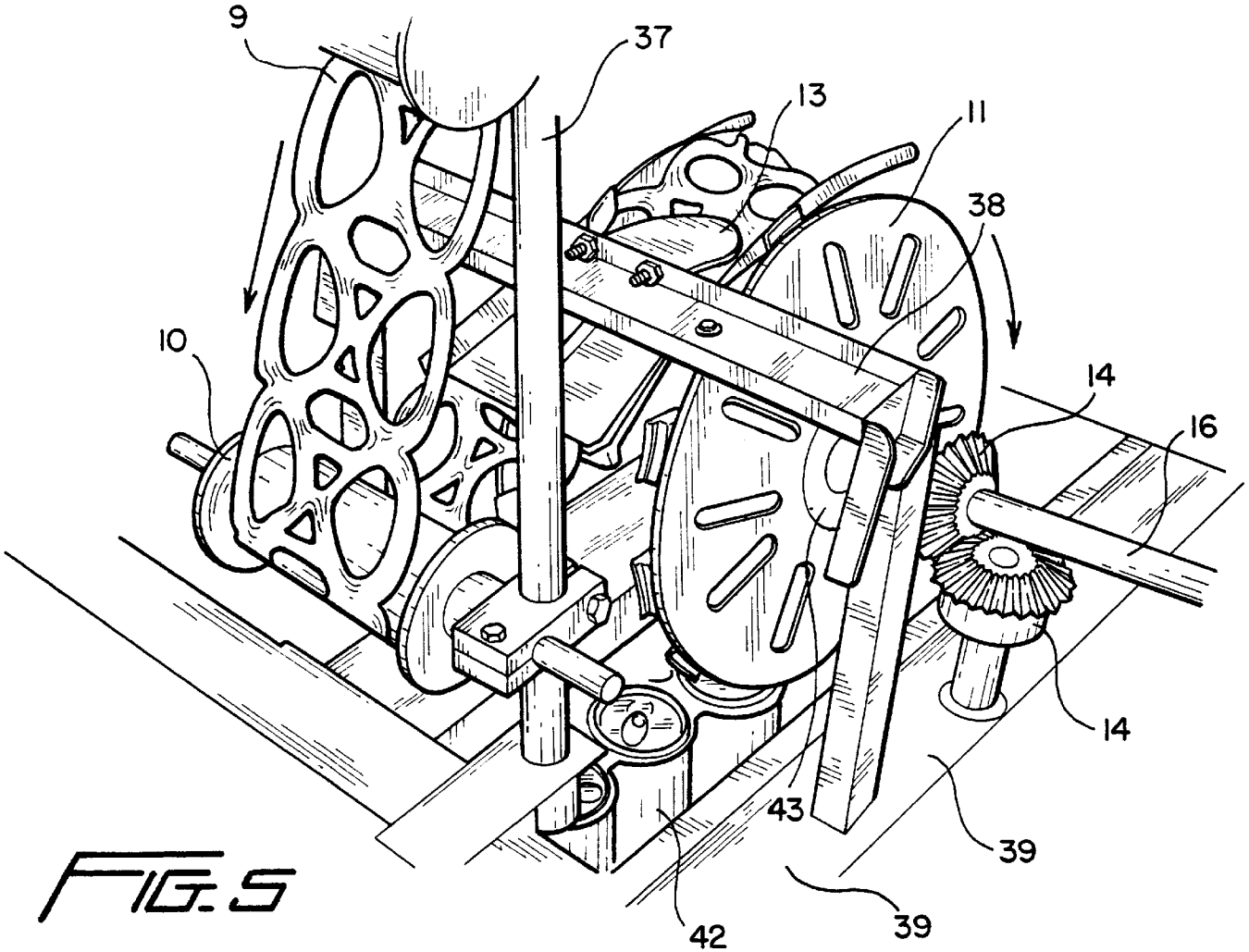
FIG. 5 is a perspective view showing in detail the entrance of the plastic carrier to the feed trough.
Figure 5A:
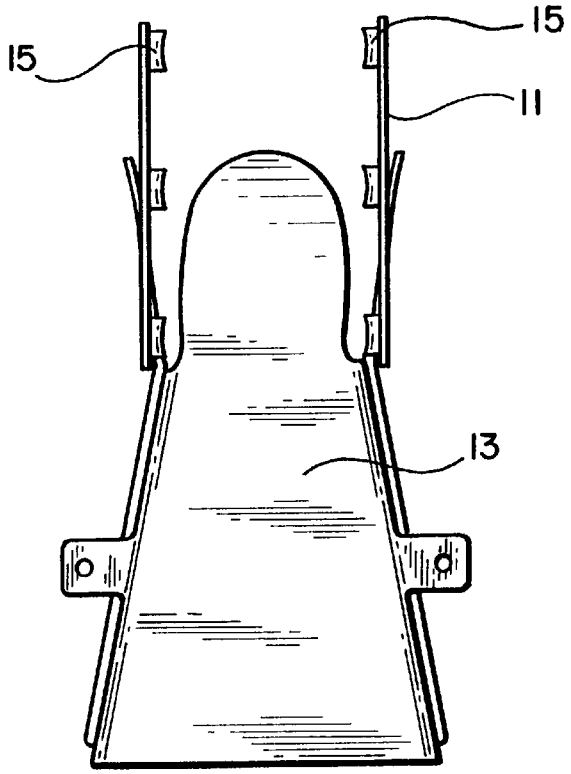
FIG. 5A is an elevation view which shows the feed trough and entrance for the jaws.
Figure 6:
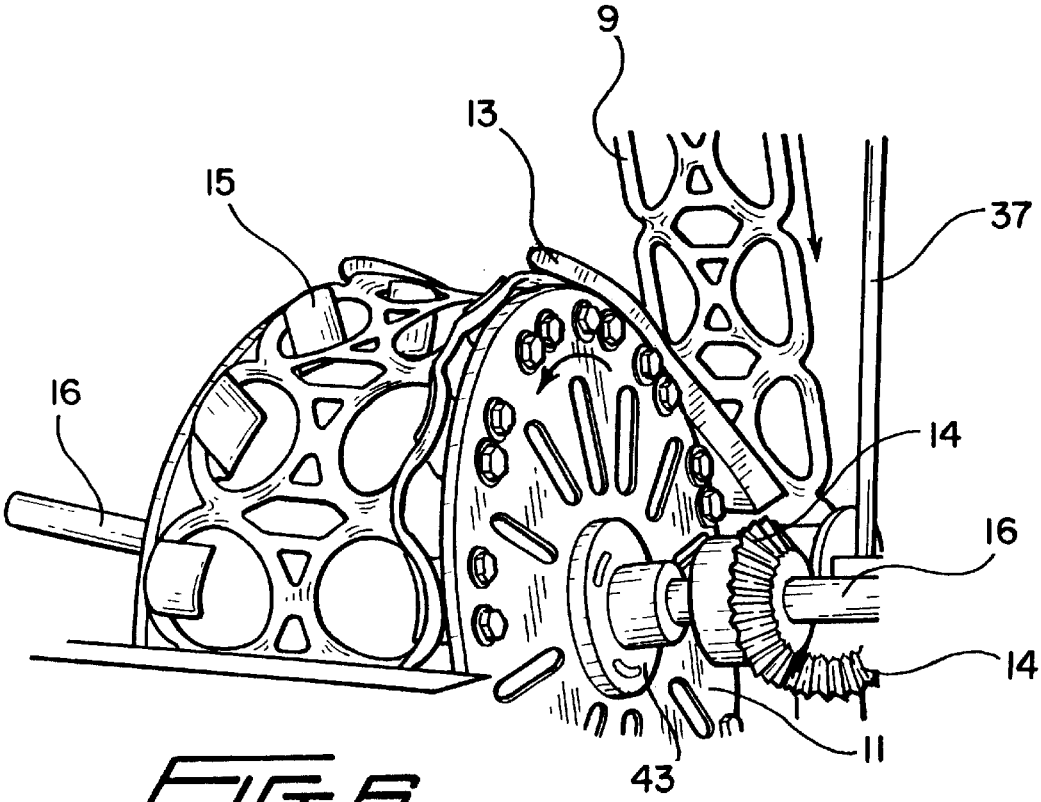
FIG. 6 is a perspective view showing how the jaws hold and start the opening of the carrier or fastener.

FIG. 1 shows the machine totally assembled, and FIGS. 5A and 6 show additional detail parts thereof, wherein there is shown the location of the reel 8, for the plastic carrier 9, and the path thereof through the carrier rollers 10. A feed trough 13, in addition to guiding the carrier 9, prefolds the side ends of the plastic carrier 9 to prevent it from being bent inwardly and to be inappropriately captured by the jaws 15 of the plates 11, that is, starts the folding of the carrier ends, which is not done in any of the prior art machines, and once the carrier 9 is folded, it is located in the plates 11, with jaws 15. These one piece jaws 15, as can be seen in FIG. 16, are not made of two or more pieces as those in the prior art, and have two threaded holes to hold the plates 11 by means of screws and two guiding holes to easily and rapidly locate them in position.

Figure 16:
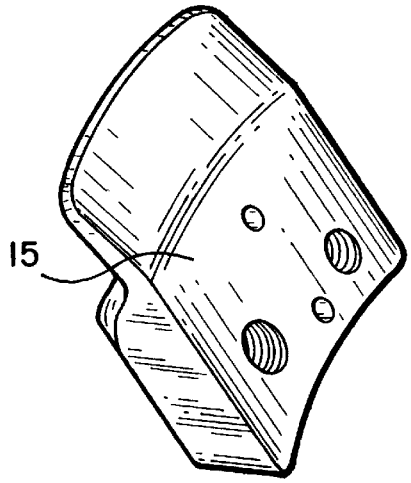
FIG. 16 is a perspective view of the one piece jaw used in the plates of the present invention.

As can be seen from FIG. 16, the front face is concave and the back upper face is convex so that the carriers 9 take the container shape and become open without breaking. This back upper face is where the carrier 9 will be received. The lower back face of the jaw 15 is flat to adapt it to the side face of the plates 11.

In FIG. 2 there is seen the conveyor 35, running from an entrance for the containers 42 to an exit thereof for the containers 42 when they are already packaged. This conveyor 35 is comprised of plastic tablets 5, as is well known in the art, although it can be built from another type and material. Further, the conveyor 35 includes a stainless steel frame on which plastic guides 4 are mounted, allowing side shift of the containers 42. FIG. 2 shows the entrance zone of the conveyor 35, with the container separating plate 3, dividing the containers into two rows to align them and thus allow their proper entrance to the carrier applying zone. On this plate 3 are mounted two reflectors 2, one on each face of this separating plate 3 on which infrared rays impinge from detectors 1, to sense the presence or absence of the containers 42, on the conveyor 35.

Figure 7:
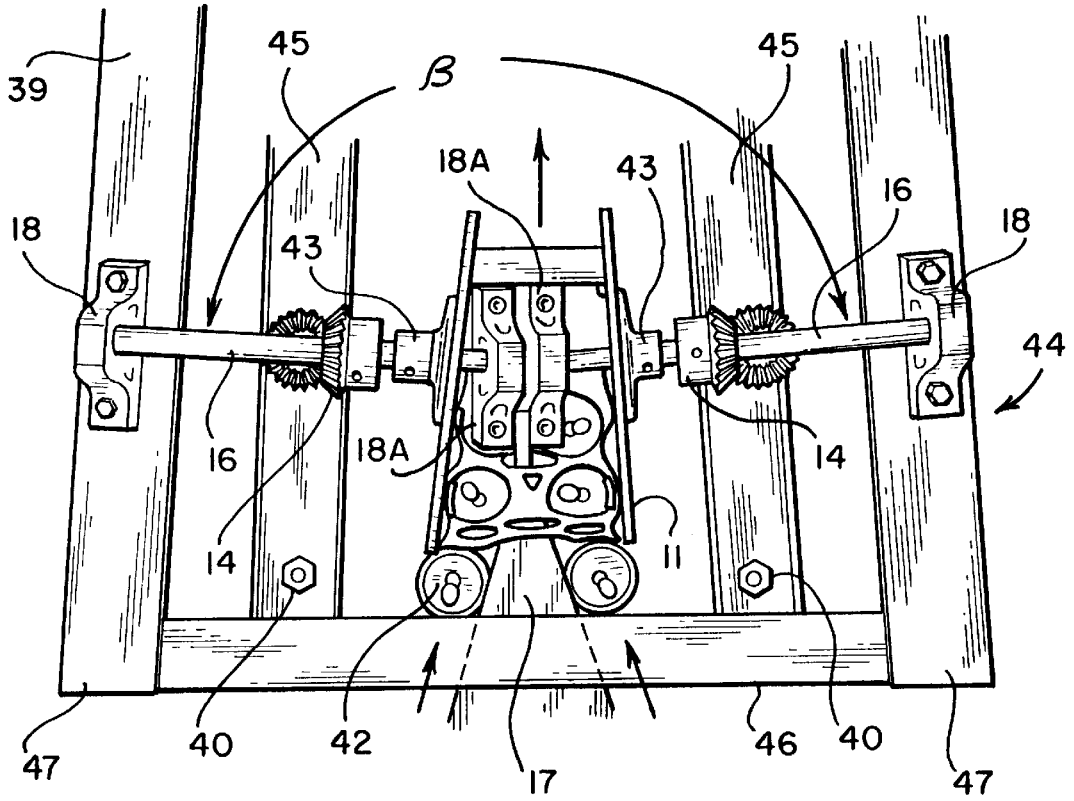
FIG. 7 is a top plan view showing the incline angle between the driving shafts of the jaw plates.

At the end of the separating plate 3, and already in the carrier applying zone, are located two non-metallic material plates, 17 preferably nylon, see FIGS. 7, 8*a* and 9, opening the two rows of containers 42, to strike tangentially the nylon stars 12, and with this reducing the excessive pressure between the containers 42 in the conveyor 35. The stars 12 upon spinning, synchronize the longitudinal movement of the containers 42 with the circular movement of the plates 11, and jaws 15, to thus apply the carrier 9, exactly on the containers 42.

Figure 3:
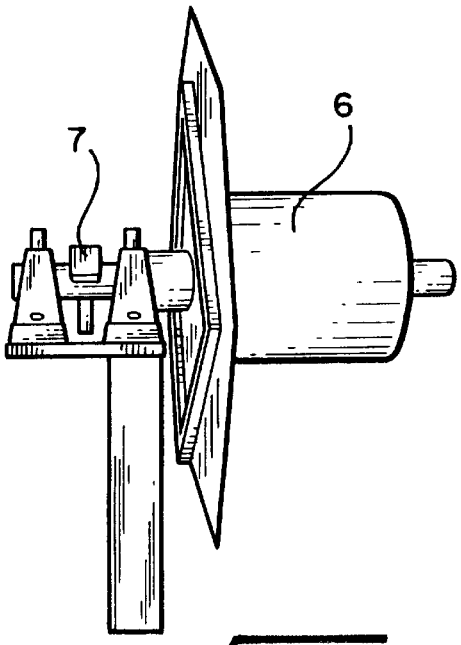
FIG. 3 is a front view of the reel carrier and its brake.

In the upper part of the machine is located a device shown in FIG. 3, wherein the reel movement of carrier 6, can be seen with its brake 7, which controls the reel 8, avoiding rough movements or spin inertia, further giving the required tension to the carrier 9, for its correct application to the feed trough 13. This brake 7, is a manually adjustable brake which comprises a support and a brake shoe in contact with the reel carrier rotation shaft 6.

Figure 8:
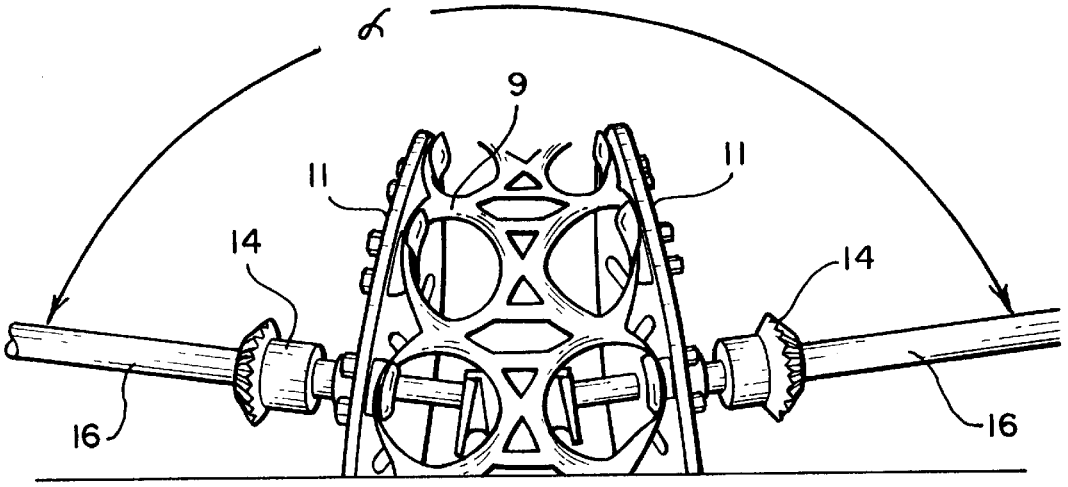
FIG. 8 is a front elevational view of the entrance of the containers and in which is shown an incline angle between the driving shafts of the jaw plates.

In FIG. 4, the path of the carrier 9 is shown. Once withdrawn from the reel 8 and conveyed over carrier rollers 10, the carrier 9 is thereafter introduced to the feed trough 13, which has a double role, in the first place and due to its two piece design and having upwardly bent side ends, allows the carrier 9 to pass therebetween, folding the edges of the carrier 9 at the exit of the feed trough 13 and in the second place lays the carrier 9 in a pair of jaws 15, and at this point stats the entrance to the stainless steel feed trough 13 grooves, as is more clearly appreciated in FIGS. 5*a* and 6. It should be noted that all the metallic elements are stainless steel as so stated by the sanitary requirements, however it is possible to use another type of metal or material suitably performing the corresponding function. Once the carrier 9 is located, on the jaws 15, the carrier 9 opens, see FIG. 6, as the plates 11, spin clockwise, as seen from the driving system side, that is with the entrance of the carrier 9, on the left side of the plates 11, this opening of the carrier 9 is attained by spinning the plates 11, with jaws 15 and by means of the shafts 16, angularly shifted with preset angles on the horizontal and vertical planes. The first angle $\alpha$, FIG. 8, is between the shafts 16, with reference to the vertical plane and is for obtaining the opening of the carrier 9.

Figure 11:
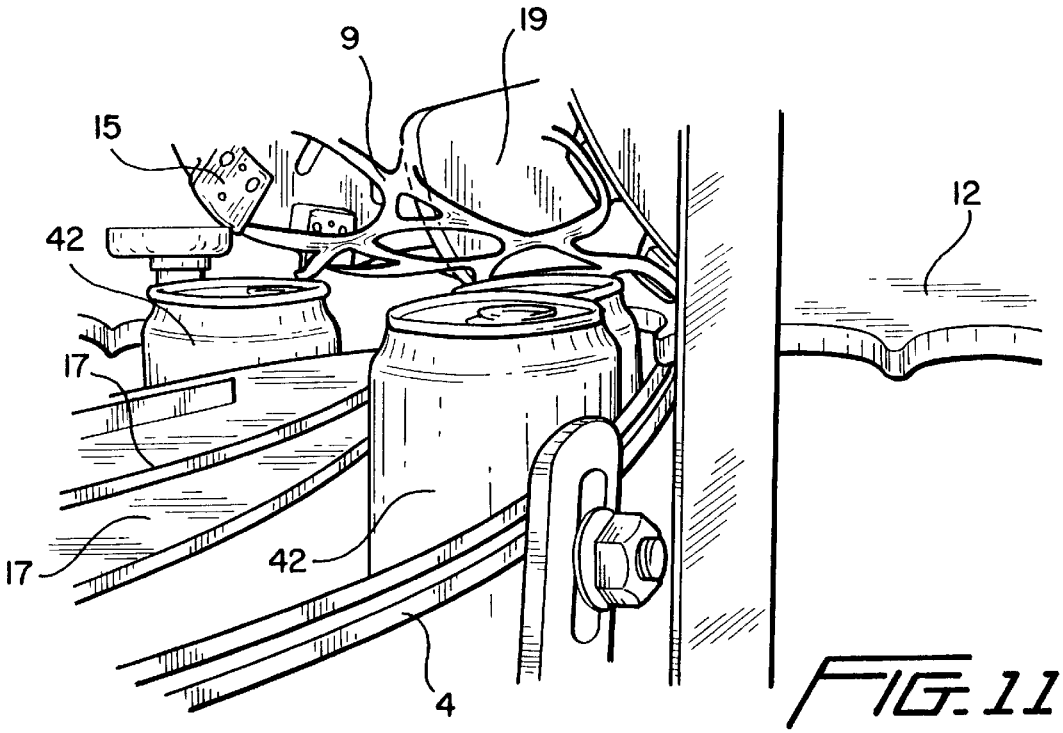
FIG. 11 is perspective view showing in detail the zone for applying the plastic carrier on the container.

Making an analogy to the handles of a clock with the movement of the plates 11, as seen from the opposite side of the main transmission system, at the 1:00 hs. position, the jaws 15, take the carrier 9 and when the jaws 15 reach the 7:00 hs. position, spinning counterclockwise, the maximum possible opening of the carrier 9, is reached. The carrier 9 between the 7:00 and 6:00 hs. positions, closes due to the angles $\alpha$ and $\beta$, FIGS. 7 and 8, between the shafts 16 and such also helps to avoid contact between the containers 42 and the jaws 15. When the plate 11, with the jaws 15, in its path passes from the 7:00 hs. to the 6:00 hs. positions, the carrier 9 contacts the central release plate 19 and this by its design and location, forces the carrier 9, to be lowered until being free of the jaws 15, holds the containers. The central release plate 19 is located between the two rows of container 42 and between the plates 11, with jaws 15 and the stars 12 as seen in FIGS. 10 and 11 and made from stainless steel.

Figure 15:
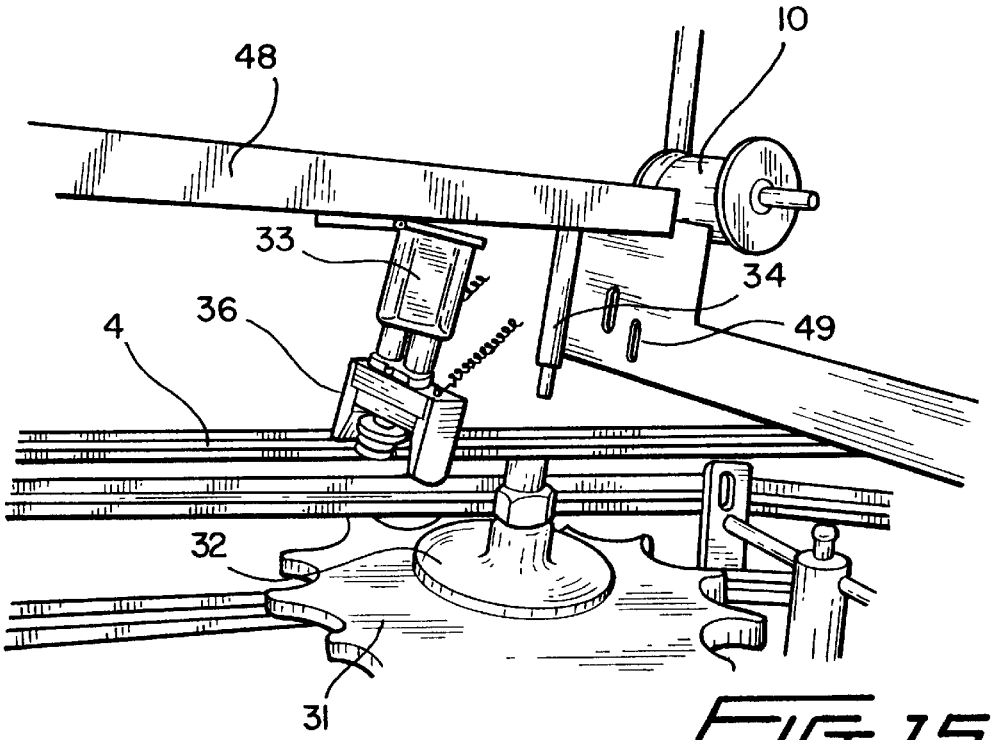
FIG. 15 is a partial perspective view showing the cutting system and a roller carrier.
Figure 17:
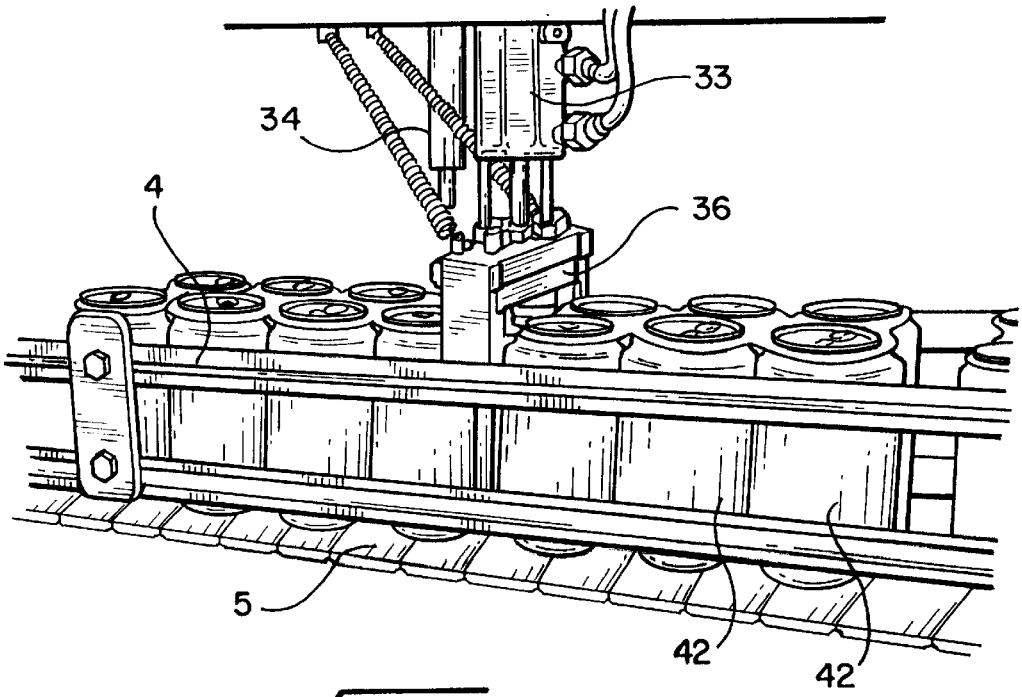
FIG. 17 is a partial perspective view showing the plunger assembly in the cutting position.

Once the plastic carrier 9 is applied to the containers 42, the containers should maintain their movement on the conveyor 35 and be received by the star 31, of the cutting station, FIG. 15, having a brake 32 coupled, thereto for reducing the container speed with reference to the tablets 5, and for stopping the containers so as to permit a plunger with the knives and dividers 36 and the carrier 9 is cut, FIGS. 15 and 17, so that further the infrared ray detector 34 may accurately sense the passage of the containers 42 and sends a signal to an electronic counting system, which in turn generates an electric signal activating a pneumatic electrovalve 41, which in turn activates the pneumatic plunger 33, having coupled in its stem a mechanism with three nylon centering devices and two blades, FIG. 15. These centering devices are used to accommodate the containers 42, before both blades start the cut of the carrier 9. This cutting device is mounted on an auxiliary frame 48 and is height adjustable by means of eyelets 49 and 50 as seen in FIGS. 1 and 15. On this same auxiliary frame 48 are mounted the optoelectronic detector 34 and the hinge and plunger 33 as well as the cutting assembly 36.

The signal produced by the sensor 34 is sent to the electric and electronic control system, in which with a simple switch movement is selected the number of containers in the package, and this system generates an electric signal to the pneumatic electrovalve 41, which in turn activates the pneumatic plunger 33 to cut the carrier 9 and thus obtain 2, 4, 6, 8 or more containers per package as was previously selected.

When the number of containers per package is required to be changed, this system does not need to carry any mechanical adjustments as the prior art machines require wherein the prior art machines also do not count even with an electronic cut selection system, nor have a cut station of the electropneumatic type as herein described.

Figure 13:
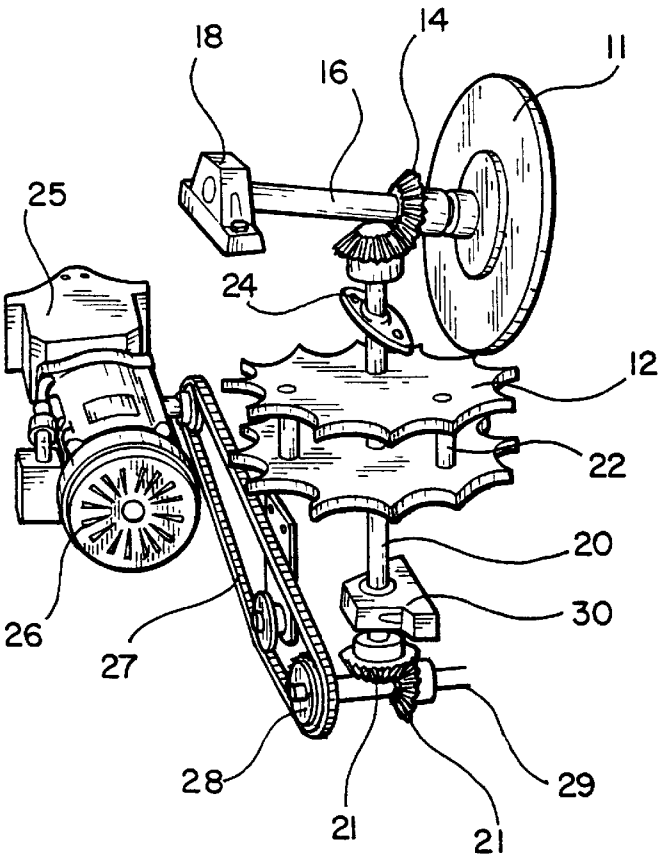
FIG. 13 is a perspective view of the main transmission, one of the secondary transmissions and the driving system.

The driving system comprises an electric motor 26 and a reducer 25, both with the necessary power to move all the machine mechanisms as seen in FIG. 13. From this reducer 25 comes out a shaft on which two sprocket wheels are located. One of these sprocket wheels by means of a chain, moves the driving axis of the conveyor 35, located at the exit end of the container packages.

Figure 14:
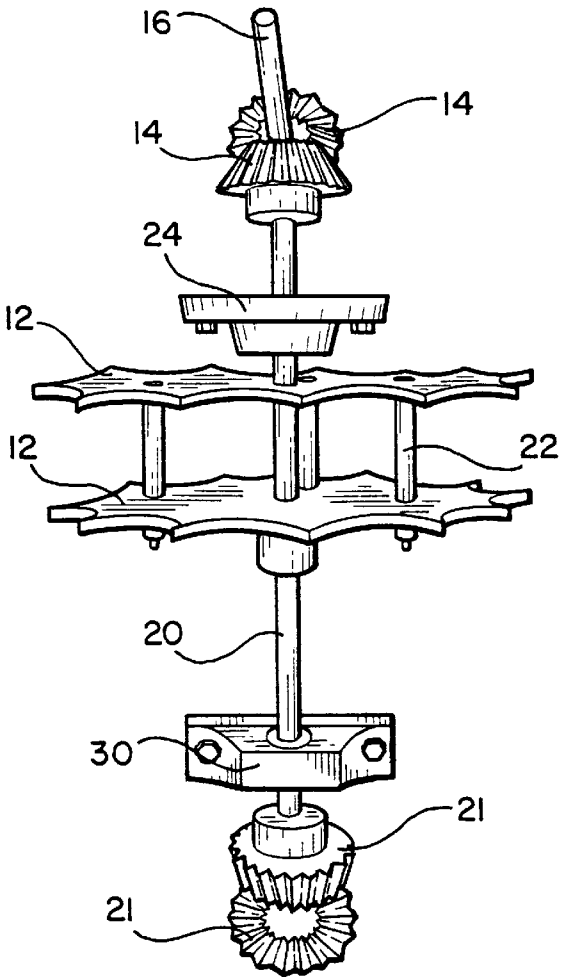
FIG. 14 is a side elevation view of the secondary transmission.

The other sprocket wheel 28 and through another chain 27, rotates the sprocket wheel 28 and this in turn rotates the shaft 29, of the main transmission, this shaft 29, passes below the conveyor 35 towards the opposite ends to transmit the movement to the secondary transmission system. Bear in mind that both secondary systems are identical. As can be seen in FIGS. 1 and 14, the shaft 29 is held by two floor self aligning bearings fastened to the conveyor frame 35. On the shaft 29 are mounted two helical bevel gears 21, one on each end of the shaft 29 and at each side of the conveyor 35, these gears 21 are coupled to respective helical bevel gears 21, mounted on vertical shafts 20, one at each side of the conveyor 35. In FIGS. 13 and 14, all the above is seen in a single side of the conveyor. Such secondary transmission is symmetrical to the other side of the conveyor. Said helical bevel gears 21, are coupled in pairs each pair forming a straight 90° angle, that is, each gear 21 is disposed at 45°. As can be seen in FIGS. 13 and 14, each shaft 20, is held at the lower part by a floor bearing 30, and at the upper part by a wall bearing 24, fixed to the main frame of the removable device 44, FIG. 8A. In the middle part of each shaft 20, that is at the height of the containers is mounted a pair of non-metallic preferably nylon material stars 12, each pair of stars 12 being fastened by means of three screws with dividers 22 equally spaced and keeping the pair of stars 12, totally parallel between them, as seen in FIG. 12. These stars 12 are holding and synchronizing the container movements with respect to the plates 11, with jaws 15, to accurately locate them at the required position for placing on top of them the carrier 9.

Each star 12, comprises semi-circular grooves allowing to match the peripheral profile of one against the other, see FIG. 12, as well as to synchronize the stars 12 position, with the jaws 15, in the plates 11. At the upper ends of the shafts 20, are located two helical bevel gears 14, with the angle allowing their coupling with the gears 14 of the driving shafts 16, which move the plates 11, with jaws 15. The two shafts 16, are mounted on two floor self-aligning bearings 18 and 18A, joined to the main frame of the removable device 44. To mechanically couple the driving shafts 16, to the plates 11, with jaws 15, a bridle 43 is used for each plate 11. The bridles 43, are mechanically coupled to the driving shafts 16 of the plates 11, with jaws 15, by means of a wedge and a stud bolt which prevents the vertical movement on the shafts 16, the bridles 43 in turn hold the plates 11 by means of three screws, passing through three concentric semicircular grooves in said bridles which allow a circular adjustment of the plates 11, as shown in FIG. 6. It must be pointed out that the plates 11 are mounted and held to the bridles 43. The plates 11 have grooves to reduce the weight thereof as shown in FIG. 1.

As can be appreciated from the above description and from FIGS. 1 to 14, the transmission movement between the shafts is carried out by means of helical bevel gears instead of the traditional chain-sprocket wheels system used in the machines of the state of the art. This provides a great simplicity to the system, at the same time reducing manufacturing costs, size of the machine, weight thereof and noise during operation.

The frame 39 of the removable device 44 holds the carrier 9 applying equipment, that is the support 37, of the support bearings 10, the support 38 of the feed trough 13, the floor bearings 18 and 18A, of the shafts 16, the plates 11, with jaws 15, the wall bearings 24, of the shafts 20, the helical bevel gears 14, and also the central release plate 19. This frame 39 is mounted on four poles 23 one of which is shown in FIG. 12, and held by four screws with a nut 40, which allows height adjustment as required by the size of the containers. Given the frame design 39, and its mounting on the poles 23, it is very simple if necessary to withdraw the same from the machine and substitute it by another previously set to the required container size. This implies that the screws with nuts 40 have a double role of holding the frame 39 of the removable device 44 and to adjust its height with reference to the containers 42. As will be seen further ahead, there is a need to modify this height when changing the height of the containers 42 to be packaged.

The frame 39 of the removable device 44 is built with conventional stainless steel structural elements welded to each other, although another type of material with similar mechanical resistance and corrosion resistance features can be used. As was previously mentioned, the angle $\alpha$ is obtained by placing in the horizontal plane at different levels, the support structural elements for the bearings; the central structural element 46 of the removable device 44 in the longitudinal center of the machine for the bearings 18A is disposed at a certain level and the external structural element 47 of the removable device 44 is disposed at an upper level for the bearings 18 holding between them, the driving shafts 16, and the helical bevel gears 14, of the plates 11, with jaws 15, as can be seen from FIG. 8A. With reference to the second angle $\beta$ from FIGS. 7 and 8*a* it can be noted that this angle is obtained by making the bearing axes 18 and 18A non-collinear in the horizontal plane. The lower structural element 45 holds the wall bearings 24 and the support 38 of the feed trough 13, the medium level structural element 46 holds the central bearings 18A and the central release plate 19, the upper level structural element 47 holds the external bearings 18 and the roller carriers support 10 and furthermore by one end holds the auxiliary frame 48 of the cutting system by means of three screws and eyelets 49.

The removable device 44 as can be seen from the above description, comprises the metallic frame 39 built with the structural elements as was previously mentioned, the support 37, the carrier rollers 10, the support 38, the feed trough 13, the floor bearings 18, the shafts 16, the plates 11, with jaws 15, the wall bearings 24, the shafts 20 and also the central release plate 19.

When the need occurs the need to modify the machine by changes in the size of the containers and at any when it is required to use the machine with another type of container with different measurements, the following procedures are to be carried out, depending on the type of container:

a) With the diameter size change on the container cap and same body diameter:

Adjustment of the distance between the plates 11 without varying the angles.

The feed trough 13 is changed, suitable for the new plastic carrier 9.

b) If the height of the containers is changed and the cap and diameters of the body of the container 42 are kept:

The frame 39 is leveled, with the screws with nuts 40, on the poles 23.

The cutting station is leveled (auxiliary frame).

c) If the change is in the diameters of the body and the cap of the container 42:

The removable device 44 is replaced.

The stars 12 are changed.

Blades and dividers 36 are substituted.

d) If the change is in the height and the diameters of the container 42:

Procedure c) is carried out.

Next, procedure b) is carried out.

Any of these change or conversion procedures do not exceed 90 minutes in working time, that is, it is very easy and fast to carry out, as well as more economical in cost, differing from the machines of the already described patents which require from one to three work days to carry out some modification in the format and conversion due to a change in dimensions of the container, and also a difference in cost considering the total cost of the machine provided in this patent application.

To control the machine movements, sequence and synchronization of the function detectors with these movements, there is used an electric and electronic control system mounted in a panel in which are also located light indicators and buttons. This control panel (not shown) generates the electrical signals of the motor 26, of the electrovalve 41, of the light indicators (not shown) and receives the signals of the on, start stop and speed buttons of the machine as well as the signals of the detectors 1, of the security reflectors 2, that of the doors (not shown) and of the optoelectronic detector 34, which detects the number of containers 42, and sends the signal to the control panel so it actuates the electrovalve 41 of the cutting system.

Obviously, many modifications and variations of the present invention are possible in light of the above teachings. It is therefore to be understood that within the scope of the appended claims, the present invention may be practiced otherwise than as specifically described herein.

We claim:

1. A low speed packaging machine for applying a plastic carrier to a set of containers, comprising:

conveyor means for conveying a plurality of containers along a predetermined horizontal path toward a carrier application station;

carrier reel means for housing a supply of a plastic carrier to be installed upon a set of containers at said carrier application station when said set of containers is conveyed to said carrier application station by said conveyor means;

a pair of carrier applicator plates, respectively having axes about which said pair of carrier applicator plates are rotatable, and disposed adjacent to said carrier application station for receiving said plastic carrier from said carrier reel means and for applying said plastic carrier upon a set of containers disposed at said carrier application station; and means for mounting said pair of carrier applicator plates such that said rotary axes are inclined, and not co-linear, with respect to each other through means of a first predetermined angle within a vertical plane, and are inclined, and not co-linear, with respect to each other through means of a second predetermined angle within a horizontal plane.

2. The machine according to claim 1, further comprising:

a feed trough for guiding said plastic carrier toward said pair of carrier applicator plates and for prefolding said plastic carrier prior to engagement of said plastic carrier by said pair of carrier applicator plates.

3. The machine according to claim 1, further comprising:

drive means, for rotatably driving said pair of carrier applicator plates, comprising a pair of shafts which are operatively connected to said pair of carrier applicator plates along said axes of said plates.

4. The machine according to claim 3, wherein:

said shafts and said axes of said pair of carrier applicator plates are inclined with respect to each other in the range from 160° to 180° in the horizontal plane and from 155° to 175° in the vertical plane.

5. The machine according to claim 4, wherein:

said axes are inclined with respect to each other in the horizontal plane through means of said second predetermined angel of 171° and with respect to each other in the vertical plane through means of said first predetermined angle of 165°.

6. The machine according to claim 3, further comprising:

bridle means for operatively connecting said carrier applicator plates to said driving shafts.

7. The machine according to claim 6, further comprising:

a support frame:

said driving shafts respectively pass through said pair of carrier applicator plates; and a pair of bearings are operatively connected to opposite ends of each one of said driving shafts wherein one of said pair of bearings, operatively connected to a first end of one of said driving shafts and disposed adjacent to a respective one of said carrier applicator plates, is located upon a first elevational level of said support frame and at a substantially central portion of the machine, while the other one of said pair of bearings, operatively connected to a second end of said one of said driving shafts disposed remote from a respective one of said carrier applicator plates, is located upon a second elevational level of said support frame so as to accommodate said inclination of said driving shafts within said vertical plane.

8. The machine according to claim 7, wherein:

said pair of support bearings for each one of said driving shafts are disposed within different horizontal planes with said other one of said lair of bearings, disposed remote from said respective one of said carrier applicator plates, being disposed at a higher elevational level than said one of said pair of bearings disposed adjacent to said respective one of said carrier applicator plates.

9. The machine according to claim 7, wherein:

said pair of support bearings for each one of said driving shafts are disposed within different vertical planes with said other one of said pair of bearings, disposed remote from said respective one of said carrier applicator plates, being disposed downstream of said one of said pair of bearings, disposed adjacent to said respective one of said carrier applicator plates, as considered in the conveyance direction of the containers.

10. The machine according to claim 1, further comprising:

one-piece jaw means, fastened to said carrier applicator plates for enlarging said plastic carrier in order to permit said plastic carrier to be mounted upon said set of containers.

11. The machine according to claim 7, wherein:

said support frame is located at said carrier application station; and said support frame is adjustably mounted upon said machine by four nut-screw fastening elements.

12. The machine according to claim 3, wherein said drive means further comprises:

a drive motor:

a drive shaft operatively connected at one end thereof to said drive motor; and a pair of helical bevel gears respectively interconnecting said motor drive shaft and each one of said shafts connected to said carrier applicator plates.

13. The machine according to claim 1, further comprising:

means, disposed at a cutting station, for cutting said plastic carrier after said plastic carrier has been applied to a predetermined number of containers;

means for counting said containers as said containers pass through said cutting station; and control means for controlling the movements of cutting means, when a preset number of said containers has passed through said cutting station, as determined by said counting means, such that said plastic carrier can be cut by said cutting means in order to form a container package comprising a predetermined number of containers.

14. In a low speed packaging machine for applying plastic carriers to containers, wherein said packaging machine comprises conveyor means for conveying a plurality of containers along a predetermined path toward a carrier application station, carrier reel means for housing a supply of a plastic carrier to be installed upon a set of containers at said carrier application station when said set of containers is conveyed to said carrier application station by said conveyor means, and a pair of carrier applicator plates rotatable about respective axes and disposed adjacent to said carrier application station for receiving said plastic carrier from said carrier reel means and for applying said plastic carrier upon a set of containers disposed at said carrier application station, a transmission system comprising:

a drive motor;

a reducer operatively connected to said drive motor;

a primary transmission system operatively connected to said reducer;

a pair of secondary transmission systems respectively connected at first ends thereof to said primary transmission system and respectively connected at second ends thereof to said pair of carrier applicator plates so as to rotatably drive said pair of carrier applicator plates in order to permit said pair of carrier applicator plates to install said plastic carrier upon a set of containers disposed at said carrier application station; and a pair of container conveyors respectively mounted upon each one of said secondary transmission systems for synchronizing the movement of said containers with that of said carrier applicator plates.

15. The transmission system according to claim 14, wherein:

said secondary transmission systems are identical to each other and are located upon opposite sides of said machine.

16. The transmission system according to claim 14, wherein:

said primary transmission system comprises a first sprocket wheel operatively connected to said reducer, a second sprocket wheel, a chain operatively interconnecting said first and second sprocket wheels so as to transmit rotary drive from said drive motor, said reducer, and said first sprocket wheel to said second sprocket wheel, a horizontally disposed shaft operatively connected to said second sprocket wheel so as to be driven thereby, and a pair of helical bevel gears respectively mounted adjacent opposite ends of said horizontally disposed shaft; and each one of said secondary transmission systems comprises a vertically disposed shaft, a first helical bevel gear disposed upon a lower end portion of said vertically disposed shaft and engaged with a respective one of said pair of helical bevel gears disposed upon said horizontally disposed shaft of said primary transmission system, a second helical bevel gear disposed upon an upper end portion of said vertically disposed shaft, a shaft operatively connected to one of said carrier applicator plates, and a third helical bevel gear mounted upon said carrier applicator plate shaft and engaged with said second helical bevel gear disposed upon said upper end portion of said vertically disposed shaft.

17. The transmission system according to claim 14, wherein each one of said secondary transmission systems further comprises:

four bearings wherein first and second ones of said four bearings are disposed adjacent said upper and lower ends of said vertically disposed shaft, and third and fourth ones of said four bearings are disposed adjacent opposite ends of said carrier applicator plate shaft.

18. The transmission system according to claim 16, wherein:

said horizontally disposed shaft of said primary transmission system is disposed beneath said conveyor means.

19. The transmission system according to claim 16, wherein:

each one of said pair of container conveyors comprises a pair of vertically spaced star plates disposed parallel with respect to each other and mounted upon each one of said vertically disposed shafts of said secondary transmission systems at an elevational level corresponding to that of said containers being conveyed for synchronizing the movement of said containers with that of said carrier applicator plates; and a plurality of spacers are interposed between said pair of vertically spaced star plates for fixedly maintaining said star plates in their vertically spaced, parallel positions with respect to each other.

20. The transmission system according to claim 16, further comprising:

bridle means for operatively respectively connecting each one of said carrier applicator plates to said carrier applicator plate shafts.

21. A cutting system for cutting plastic carriers in machines which apply plastic carriers upon selectively predetermined sized packages of containers, comprising:

a cutting station;

conveyor means for conveying a plurality of containers to said cutting station;

container counter means for counting the number of containers that have been conveyed to said cutting station and for outputting a signal when a predetermined number of containers conveyed to said cutting station has been counted;

means for inputting into said container counter means an integer number corresponding to the predetermined number of containers to be included within a selectively predetermined sized package of containers;

detector means for detecting the passage of said containers toward said cutting station and for transmitting a signal, corresponding to the passage of each container toward said cutting station, to said container counter means such that said container counter means can count the number of containers that have been conveyed to said cutting station;

cutter means disposed at said cutting station for cutting said plastic carrier; and means for receiving said output signal from said container counter means and for activating said cutter means when said container counter means has counted a predetermined number of containers to be included within a selectively predetermined sized package of containers such that said cutter means can cut said plastic carrier at a location thereof so as to include within said selectively predetermined sized package of containers said predetermined number of containers.

22. The cutting system according to claim 21, wherein:

said detector means comprise an optoelectronic detector which detects the passage of said containers towards said cutting station and transmits said signal to said container counting means.

23. The system according to claim 21, wherein said cutter means comprises:

a cutter element; and a plunger assembly having said cutter element mounted thereon and including an extensible-contractible plunger for moving said cutter element toward and away from said plastic carrier so as to perform a cutting operation with respect to said plastic carrier.

24. The system according to claim 21, wherein said conveyor means comprises:

a non-metallic star having configured portions for accommodating said containers; and brake means connected to said non-metallic star for reducing the speed of said containers as said containers approach said cutting station.

* * * * *